US011255071B2

(12) United States Patent
Chang et al.

(10) Patent No.: US 11,255,071 B2
(45) Date of Patent: Feb. 22, 2022

(54) ROBOT AND COLLECTING METHOD FOR COLLECTING POLYMETALLIC NODULES IN DEEP-SEA

(71) Applicant: WUHAN UNIVERSITY OF TECHNOLOGY, Wuhan (CN)

(72) Inventors: Haichao Chang, Wuhan (CN); Wenhe Shen, Wuhan (CN); Xuan Cheng, Wuhan (CN); Run Tian, Wuhan (CN); Zhengchen Lian, Wuhan (CN); Lingkai Guan, Wuhan (CN)

(73) Assignee: WUHAN UNIVERSITY OF TECHNOLOGY, Wuhan (CN)

( * ) Notice: Subject to any disclaimer, the term of this patent is extended or adjusted under 35 U.S.C. 154(b) by 355 days.

(21) Appl. No.: 16/672,462

(22) Filed: Nov. 3, 2019

(65) Prior Publication Data

US 2020/0165795 A1 May 28, 2020

(30) Foreign Application Priority Data

Nov. 23, 2018 (CN) ..... 201811403955.6

(51) Int. Cl.
*E02F 3/88* (2006.01)
*E21C 50/00* (2006.01)
*E02F 3/94* (2006.01)

(52) U.S. Cl.
CPC ..... *E02F 3/8866* (2013.01); *E02F 3/94* (2013.01); *E21C 50/00* (2013.01)

(58) Field of Classification Search
CPC ..... E02F 3/8858; E02F 3/8866; E02F 3/94; E02F 3/945; E21C 50/00
USPC ..... 37/307, 313, 317, 320–323, 334, 345
See application file for complete search history.

(56) References Cited

U.S. PATENT DOCUMENTS 3,748,248 A * 7/1973 Wanzenberg et al. .. E21C 50/00 204/208
4,140,344 A * 2/1979 de Turville ..... E02F 3/88 209/162
4,281,876 A * 8/1981 Lansberry ..... E21C 35/24 175/40
4,957,622 A * 9/1990 Mims ..... E02F 3/885 210/170.04

(Continued)

FOREIGN PATENT DOCUMENTS

CN 105804755 A * 7/2016
CN 106545341 A * 3/2017

(Continued)

*Primary Examiner* — Tara Mayo-Pinnock
(74) *Attorney, Agent, or Firm* — Hemisphere Law, PLLC; Zhigang Ma

(57) ABSTRACT

A robot and a collecting method for collecting polymetallic nodules in deep-sea are provided. The robot includes an underwater moving carrier and a collecting module, and the collecting module is fixedly mounted on the underwater moving carrier. The collecting module includes a collecting frame, a collecting pump, a rack and a collecting tube, the collecting frame is installed at the bottom of the rack, and the collecting pump is a piston pump, which includes a piston and a cylinder with open lower-end. The upper part of the cylinder is a collecting area, the lower part is a piston stroke area, the collecting tube is connected to the cylinder of the collecting area, and a check valve is arranged in the middle of the piston.

10 Claims, 5 Drawing Sheets

(56) References Cited

U.S. PATENT DOCUMENTS

| | | | | |
|---|---|---|---|---|
| 7,334,358 | B1 * | 2/2008 | Whyte | E02F 3/8891 37/320 |
| 9,200,427 | B2 * | 12/2015 | Phillips | E02F 3/925 |
| 2008/0172911 | A1 * | 7/2008 | Buhr et al. | E02F 3/9212 37/317 |
| 2014/0345170 | A1 * | 11/2014 | Southerland et al. | E21C 50/00 37/324 |
| 2018/0187395 | A1 * | 7/2018 | Nagata et al. | E02F 5/006 |

FOREIGN PATENT DOCUMENTS

| | | | | |
|---|---|---|---|---|
| CN | 108517911 | A * | 9/2018 | E02F 3/905 |
| KR | 20090045490 | A * | 5/2009 | |

* cited by examiner

ROBOT AND COLLECTING METHOD FOR COLLECTING POLYMETALLIC NODULES IN DEEP-SEA

FIELD OF THE DISCLOSURE

The disclosure belongs to the field of deep-sea working equipment, and relates to a deep-sea collecting operation device, in particular to a robot and a collecting method for collecting polymetallic nodules in deep-sea.

BACKGROUND OF THE DISCLOSURE

With the gradual shortage of global terrestrial metal resources and the continuous growth of the world population, the contradiction between metal supply and demand has become increasingly prominent, and the abundant deep-sea polymetallic nodules have become an important hope for solving the problem of human metal resources. Therefore, the development of deep-sea polymetallic nodules collection technology for the commercial exploitation of deep-sea polymetallic nodules can solve the shortage of metal resources to some extent and alleviate the human resource crisis.

However, the collection environment of deep-sea polymetallic nodules is harsh and technical barriers are difficult to break. At present, there is still no mature technology for environmentally friendly collection of deep-sea polymetallic nodules at home and abroad. Some of the small collecting methods are still limited to the scientific research nature, and they are costly, inefficient, and polluting, and difficult to adapt to the complex and varied deep sea terrain and environment, so it is difficult to use as a commercial mining method.

SUMMARY OF THE DISCLOSURE

The disclosure provides a design scheme for a deep-sea polymetallic nodules collection robot for the technical problems of the above-mentioned deep-sea polymetallic nodules collection. The disclosure draws on the technical principle of the collecting pump and develops a deep-sea polymetallic nodule collecting robot technology. This technology adopts the suspension walking mode, and is more suitable for the complex terrain of the deep sea. It has the advantages of low pollution, high efficiency and low cost.

At the same time, the disclosure adopts a hollow collecting frame, and uses high-speed water flow to separate polymetallic nodules and muddy sand to a certain extent, thereby improving the collection efficiency.

The disclosure is achieved by the following technical solutions:

a robot for collecting deep-sea polymetallic nodules, including an underwater moving carrier and a collecting module; wherein the collecting module is fixedly mounted on the underwater moving carrier and thereby is movable underwater by the underwater moving carrier; the collecting module includes a collecting frame, a collecting pump, a rack, and a collecting tube; the collecting frame is installed at a bottom of the rack, the collecting pump is a piston pump which includes a piston and an cylinder with open lower-end, an upper part of the cylinder is a collecting area, a lower part of the cylinder is a piston stroke area, the piston is installed in the piston stroke area, an end of the collecting tube is connected to the collecting area of the cylinder, a check valve being one-way openable downwardly is provided in a middle of the piston, the collecting pump is mounted on the rack, an outlet at the lower-end of the cylinder is connected to an inlet at a top of the collecting frame, and the other end of the collecting tube extends downwardly in order to contact with a ground around the collecting module.

As an improvement, the cylinder is a circular cylinder, an upper surface of the piston is in a shape of a slope having a low central portion and a high periphery, and the check valve being one-way openable downwardly is hinged in the middle of the piston.

As an improvement, the check valve is controlled by a power component, and the switching frequency is consistent with the piston movement frequency. When the piston moves downward, the electric power element acts on the check valve to make it close quickly. When the piston moves upward, the electric power element generates a reverse force acting on the check valve to make it open quickly.

As an improvement, the piston is configured for being driven to move upwardly and downwardly by a driving device; and the driving device includes an eccentric wheel, a connecting rod and a motor, the eccentric wheel is mounted at the lower part of the cylinder, the eccentric wheel is connected to the piston through the connecting rod, the motor and the eccentric wheel are coupled by power transmission, and the motor is mounted in the rack.

As an improvement, a number of the collecting pump is multiple, the multiple collecting pumps correspondingly are provided with multiple the collecting tube respectively, the multiple collecting tubes are evenly disposed on both sides of the rack, and a nozzle of each the collecting tube is provided with a thickened protection ring.

As an improvement, the collecting tube is made of a rigid material, and an inlet of the collecting tube is a port with gradually reduced size.

As an improvement, the collecting frame is made of a porous mesh and includes a bottom storage section and a top separation section, the top separation section is a slope-shaped filter screen and configured for separating polymetallic nodules and muddy sand.

As an improvement, the underwater moving carrier includes an airfoil floating cabin, a compressed air chamber and an underwater propeller, the airfoil floating cabin is a sealed hollow chamber and installed above the rack by a fixing device, the airfoil floating cabin is provided with three ports with control valves being an air intake port, an air exhaust port, and a water intake/exhaust port respectively; the air intake port is communicated with the compressed air chamber through a connecting pipe, the air exhaust port and the water intake/exhaust port are communicated with an external environment of the airfoil floating cabin; a number of the compressed air chamber is two and the two compressed air chambers are symmetrically fixedly mounted on both sides of the rack; the two compressed air chambers are used for filling a high pressure gas therein and adjusting an amount of water in the airfoil floating cabin by the high pressure gas to realize ascending and diving functions, and the underwater propeller is configured for propelling the underwater moving carrier to move underwater.

As an improvement, the underwater propeller includes two propellers, and the two propellers are symmetrically mounted on both sides of the collecting frame below the rack, and the two propellers are independently controlled through two motors at rotational speeds to achieve forward, backward and differential steering.

As an improvement, an image acquisition module is mounted on the underwater moving carrier.

A method for collecting deep-sea polymetallic nodules using a robot, including the following steps:

Step 1, filling an airfoil floating cabin of the robot with water to make the robot dive to a deep-sea working area, and then draining off the water by a high pressure gas in a compressed air chamber to make the robot be in a suspended and force-balanced state;

Step 2, identifying a polymetallic nodule distribution area by a camera of an image acquisition module, moving the robot to the polymetallic nodule distribution area by an underwater propeller and making an inlet of a collecting tube aim at the polymetallic nodule distribution area;

Step 3, starting a collecting pump to make a piston of the collecting pump move downwardly to thereby form a negative pressure in a collecting area of a cylinder of the collecting pump, and sucking a mixture of polymetallic nodules and muddy sand at the inlet of the collecting tube under an action of the negative pressure;

Step 4, moving the piston of the collecting pump upwardly, to make the mixture of polymetallic nodule muddy sand enter a collecting frame through a check valve disposed on the piston;

Step 5, discharging a certain amount of water in the airfoil float cabin to allow the robot to be suspended and force-balanced again when the robot sinks caused by that the collecting frame become heavier as the collecting progresses;

Step 6, repeating the step 2 through the step 5 to perform the collecting, and moving the robot to a transfer station for releasing the collecting frame or to float up by an underwater moving carrier when the collecting frame is full, so as to complete the collecting of deep-sea polymetallic nodules.

Compared with the prior art, the beneficial effects of the present disclosure are:

The disclosure utilizes the driving device, the airfoil floating cabin, the compressed air chamber and the underwater propeller to keep the robot in a floating state during the collecting and walking process, thereby avoiding the influence of the complex topographic features of the seabed. At the same time, it also avoids serious damage to the deep-sea environment and preserves environmental conditions for the regeneration of polymetallic nodules, which is conducive to the sustainable development of deep-sea resources. The disclosure designs the collecting frame into a hollow form, on the one hand, reduces the self-weight of the robot, and on the other hand, the design of the hollow and slope-type collecting frame can filter out part of the useless mud, clean the polymetallic nodules, increase the single collection amount, and improve the collection efficiency. The disclosure utilizes the pressure difference of the collecting pump to collect polymetallic nodules, thereby avoiding large-scale damage to the seabed environment. This design uses the concept of bionics, the collecting tube mimics the octopus tentacles, and the airfoil floating cabin mimics the design of the "bird wing". The deep ocean current provides a part of the buoyancy to the lift generated by it, which is compatible with the deep-sea environment and reflects the green design concept.

DETAILED DESCRIPTION OF PREFERRED EMBODIMENTS

Figure 1:
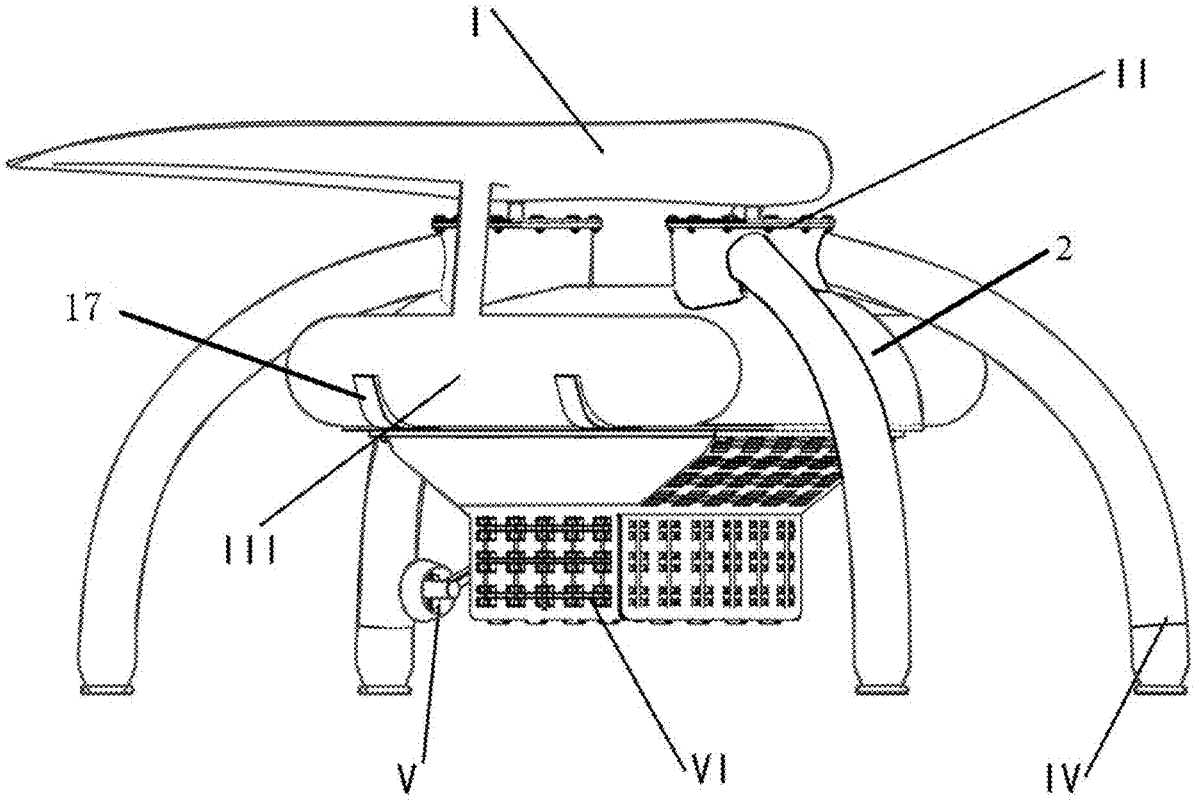
FIG. 1 is a schematic overall view of a robot for deep-sea polymetallic nodules collection.
Figure 2:
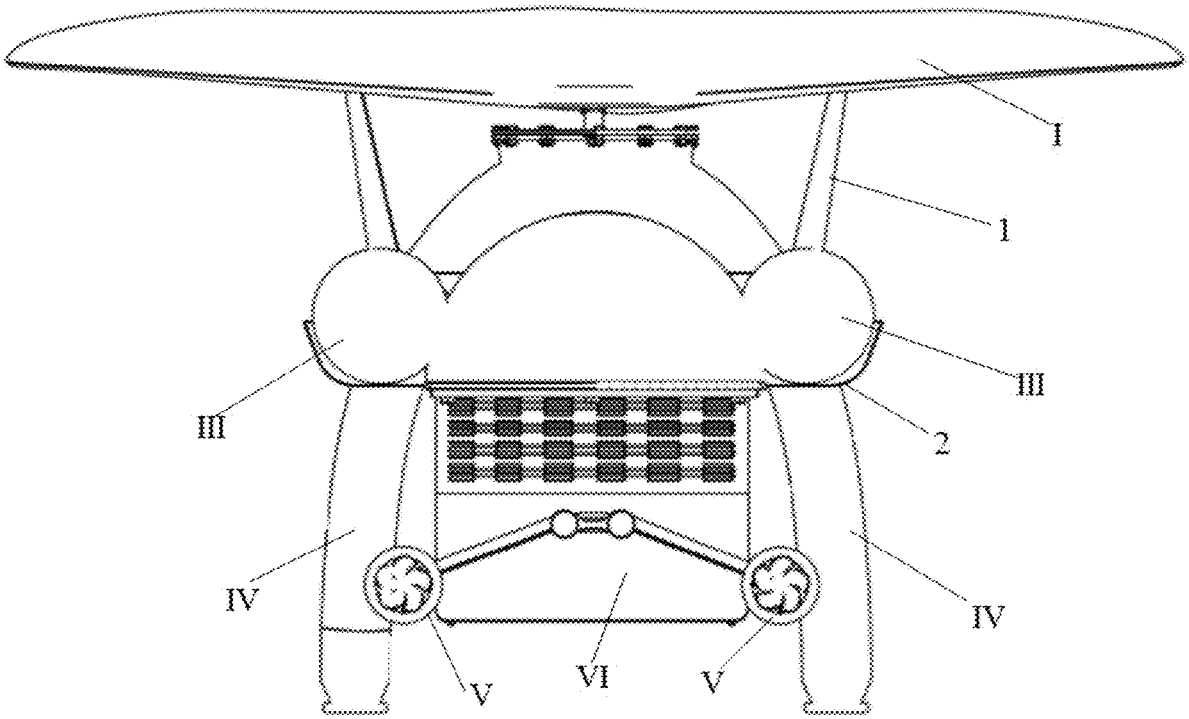
FIG. 2 is a rear view of the robot of the present disclosure.
Figure 3:
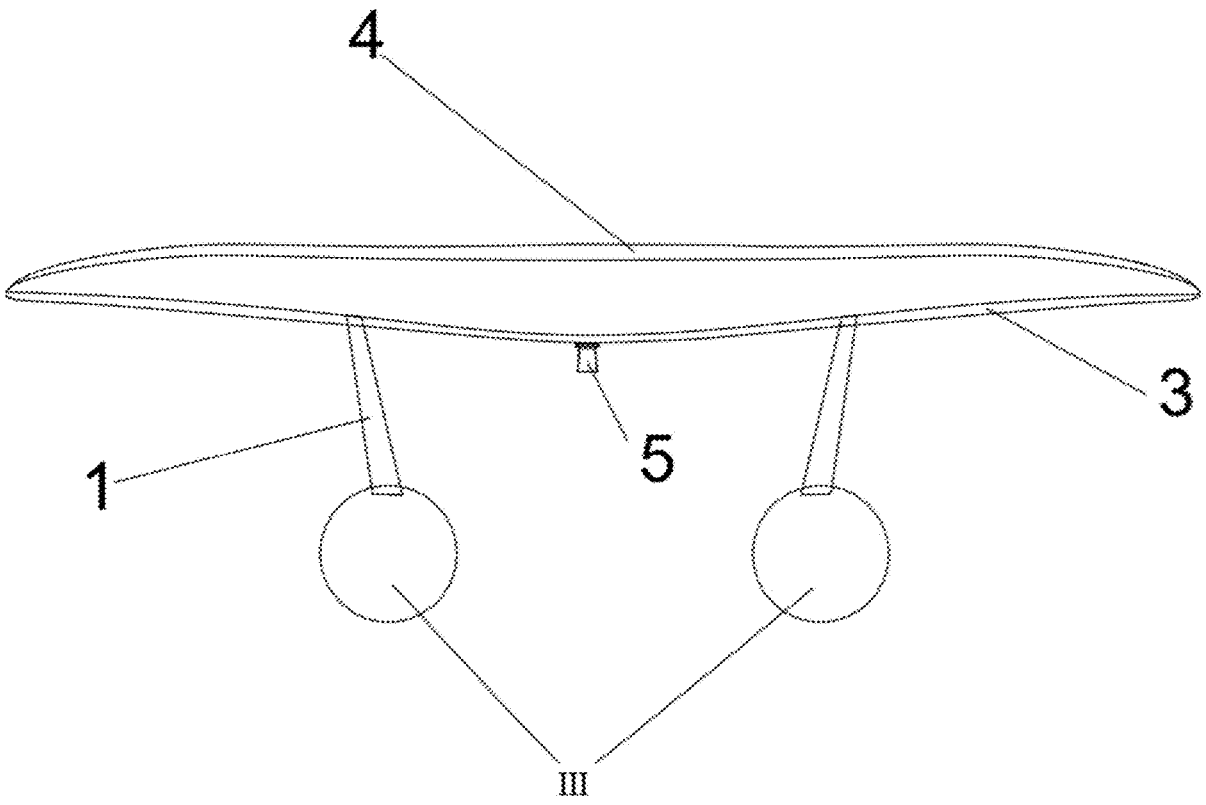
FIG. 3 is a schematic diagram of the joint of an airfoil float cabin and compressed air chambers.
Figure 4:
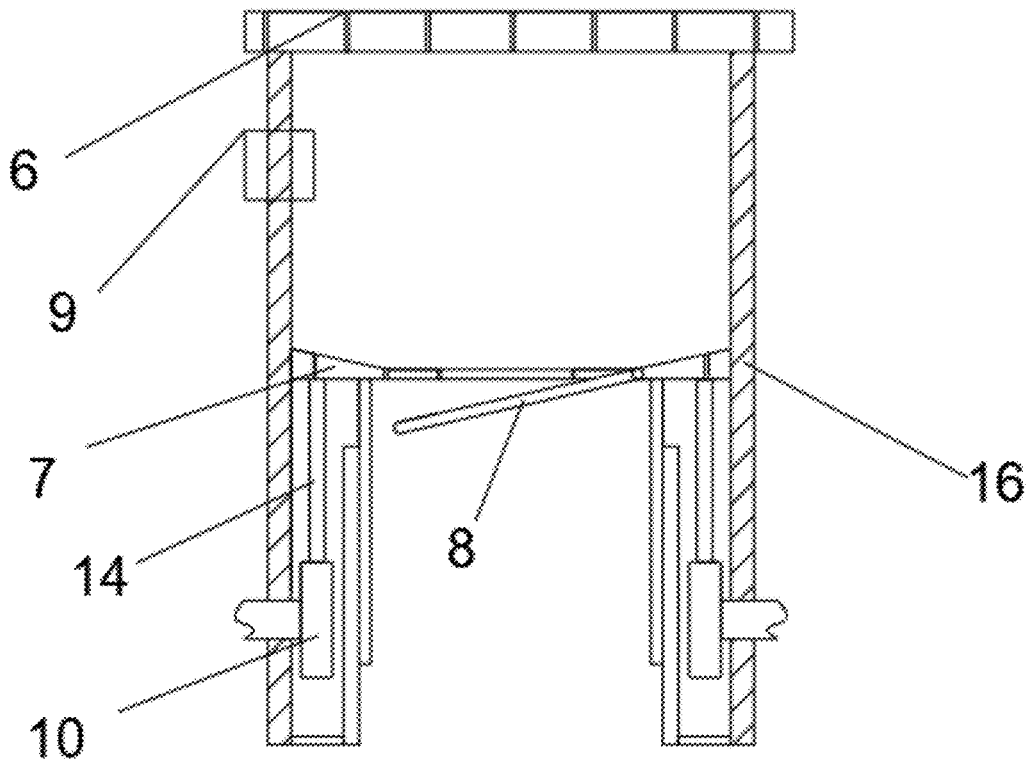
FIG. 4 is a schematic view of the structure of the collecting pump.
Figure 5:
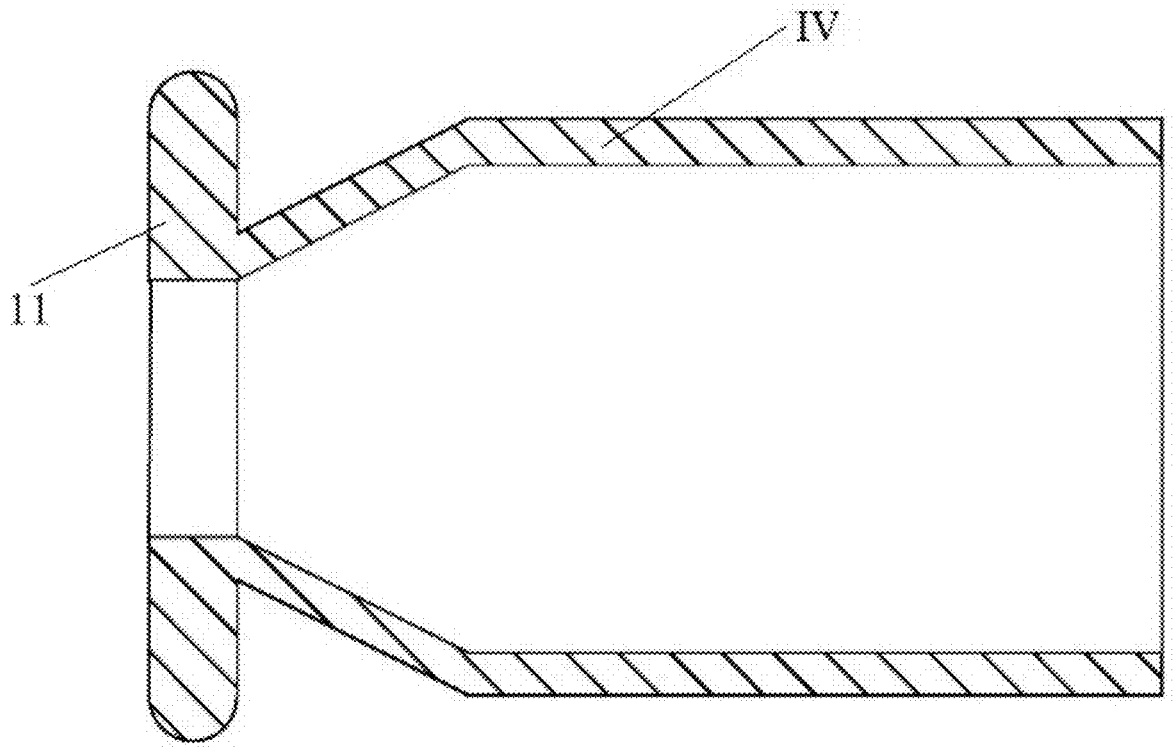
FIG. 5 is a schematic view of the inlet structure of the collecting tube.
Figure 6:
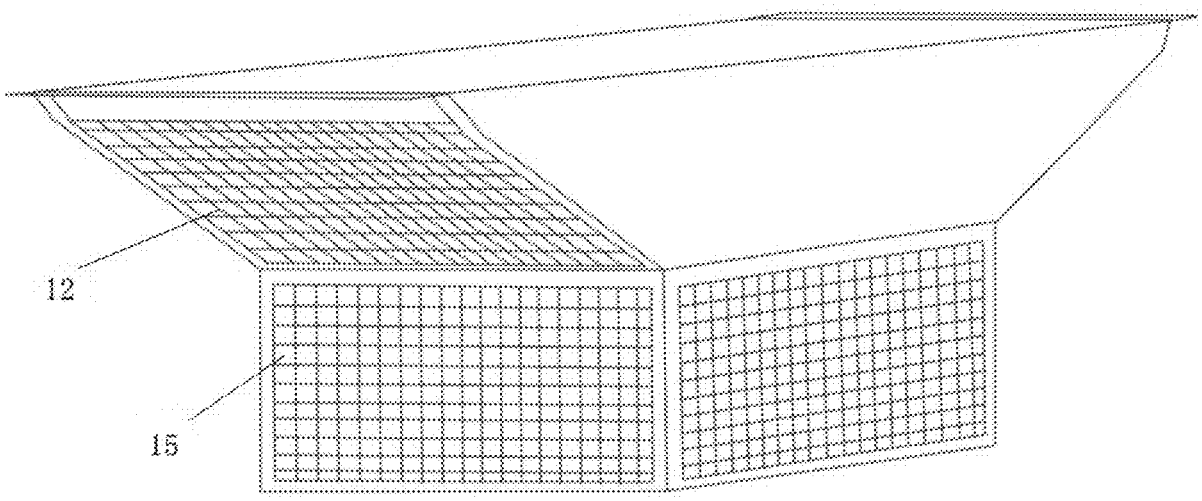
FIG. 6 is a schematic structural view of a collecting frame.
Figure 7:
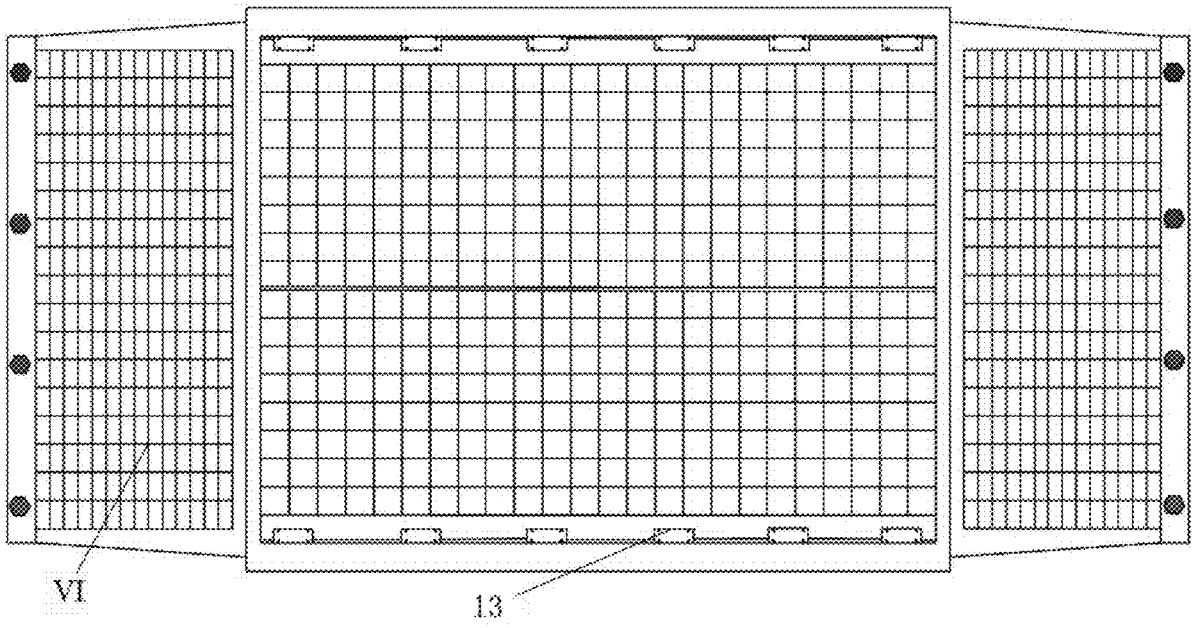
FIG. 7 is a schematic view of the bottom of the collecting frame.

The disclosure is illustrated by the following figures in conjunction with the accompanying drawings.

As shown in the drawings, a robot for deep-sea polymetallic nodules collection includes a rack 2, an airfoil floating cabin I, a compressed air chamber III, a collecting tube IV, a collecting pump II, a collecting frame VI, and an underwater propeller V.

The airfoil floating cabin I mimics the shape and structure of the wing and is placed on top of the robot. The airfoil floating cabin 1 includes a water intake/exhaust port 3 at the lower part of the tail of the device, an air exhaust port 4 at the upper part of the tail of the device, and a connecting pipe 1 connected to the airfoil floating cabin I at the lower portion, and two lower side fixing devices 5. The connecting pipe 1 is located on both sides of the airfoil floating cabin I, and is respectively connected with the compressed air chambers III on both sides; the fixing device 5 is located at the front and rear ends of the airfoil floating cabin I, and is respectively connected with the upper top plate 6 of the collecting pump II, as shown in FIG. 1. The connecting pipe 1 and the fixing device 5 together ensure the structural joint strength.

The compressed air chambers III have two, symmetrically arranged on both sides of the robot, and on the lower side of the airfoil floating cabin I. The compressed air chamber III includes an upper connecting pipe 1 and fixing devices 17 at both ends. The compressed air chambers III are fixed to the rack 2 by the fixing devices 17, and the compressed air chambers III communicate with the airfoil floating cabin I at the upper portion of the robot through the upper connecting pipe 1, and a gas valve is arranged in the middle portion of the connecting pipe 1.

The gas valve of the connecting pipe 1 is opened, and the valve of the water intake/exhaust port of the airfoil floating cabin I is opened, the compressed air in the compressed air chamber III enters the airfoil floating cabin I under the pressure difference, and the pressure inside the compressed air chamber III decreases (but is still greater than the pressure of the deep sea water), the seawater in the airfoil floating cabin I is discharged under the action of air pressure, the total mass of the device is reduced, the buoyancy is greater than/equal to gravity, and the robot floats/maintains balance. The gas pipe of the connecting pipe 1 is closed, and the air exhaust port 4 of the airfoil floating cabin I and the water intake/exhaust port 3 are opened, the air in the airfoil floating cabin I is discharged under the pressure difference generated by the external seawater pressure. The seawater enters, the total mass of the device increases, the buoyancy is less than/equal to gravity, and the robot sinks/maintains balance.

The collecting pump II should include a cylinder 16, an upper top plate 6, a piston 7, and a driving device. There are two collecting pumps II, and the cylinder 16 is a circular cylinder, which is arranged at the front and rear ends of the rack 2 and above the collecting frame slope 12, and is directly connected to the rack 2. The upper part of the cylinder 16 is a collecting area, the lower part is a stroke area of the piston 7, and the piston 7 is mounted in the stroke area of the piston 7. The reciprocating motion of the piston 7 is controlled by the driving device. The driving device is composed of two sets of eccentric wheels 10, a connecting rod 14 and a motor, and is respectively located in the interlayer on both sides of the cylinder 16, the eccentric wheel 10 is mounted on the lower side wall of the cylinder 16 by bearings, and the eccentric wheel 10 is hinged to the piston 7 via a connecting rod 14, and the eccentric wheel 10 is in contact with the motor.

There are four collecting tubes IV, and each collecting pump II is provided with two collecting tubes IV, and the two collecting tubes IV are symmetrically arranged on the middle of the collecting pump II. That is, the wall of the cylinder 16 is on the side wall of the collecting area, and the distance between the front and rear collecting tubes to the symmetry plane of the robot is not equal. The inlet of the collecting tube IV adopts a shrinkage design to increase the water flow speed at the collection port, thereby increasing the internal pressure difference between the collecting tube IV, enhancing the collection capacity, and performing reinforcement treatment to increase the bearing strength. The collecting tube IV is made of a rigid material to maintain its working form and maintain the collecting range. The reinforcing mode is arranging a thickened protective ring at the entrance of the collecting tube. The protective ring can effectively prevent structural damage caused by stress concentration on the collecting tube, and the protective ring increases the cross-sectional area at the nozzle of the collecting tube. It can effectively reduce the pressure when the collecting tube accidentally bottoms out, prevent the collecting tube from being damaged due to accidental bottoming and reduce the degree of subsidence; at the same time, if the robot suddenly falls due to turbulent flow on the seabed, the rigid collecting tube IV will also play a certain role in supporting and protecting.

At work, polymetallic nodules will enter the collecting pump II from the collecting tube IV. The piston 7 moves downward and the check valve 8 is closed under the action of the power element. Under the action of the pressure difference between the internal and external pressures of the pump, an upward flow of water is generated in the collection port and the collecting tube IV, and the polymetallic nodules are moved upwards. At this time, the polymetallic nodules are sucked into the cylinder 16 of the collecting pump II together with the sea cement sand. The piston 7 moves upward, and the check valve 8 is opened by the action of the power component. The mixture of seawater, polymetallic nodule and muddy sand in the cylinder 16 is discharged from the check valve 8, and the polymetallic nodules are then gravity-introduced into the lower collecting frame VI. As the piston 7 moves upwards, the water in the pump and the polymetallic nodules are discharged, and the collecting pump II returns to the original state, and the collection is completed. The average speed of the piston movement is set to be higher than the average speed of the mixture of polymetallic nodule and muddy sand in the collecting pump. Therefore, the negative impact of the mixture of polymetallic nodule and muddy sand on the opening and closing of the check valve 8 is low, and the pump can still operate normally. The mixture of seawater, polymetallic nodule and muddy sand entering the collecting frame VI first flows through the slope section of the collecting frame VI. The muddy sand falls from the mesh of the collecting frame VI and falls into the seawater. The polymetallic nodules are rolled down to the bottom storage section 15 because they are larger than the mesh of the collecting frame VI.

The collecting frame VI is disposed at the bottom of the robot and is fixedly mounted on the rack 2. The collecting frame VI is made of a porous metal mesh, including a slope section and a bottom storage section 15. The bottom of the collecting frame VI is also provided with a shutter valve or a movable leaf structure 13 that can be opened for easy discharge. The slope is a slope with an inclination angle of 120 degrees. The grid is a mesh design that is slightly smaller than the diameter of the polymetallic nodules and is evenly distributed in the collecting frame VI. The leaflet structure is arranged at the bottom of the collecting frame VI.

When the robot is working, the collected polymetallic nodules first fall on the slope and then fall into the collecting frame VI by its own gravity. Avoid the accumulation of polymetallic nodules at the drop. The collecting pump II will discharge the high-speed water flow under the operation process, and the collecting frame VI can play the role of separating the polymetallic nodules and muddy sand, thereby greatly improving the collection efficiency. When the collecting frame VI is fully loaded, the robot moves to the transfer station, the bottom loose-leaf structure opens, and the polymetallic nodules enter the mine compartment of the transfer station.

There are two propellers V, which are used as underwater propellers to push the robot to move under water. The two propellers V are symmetrically distributed on the back of the collecting frame VI, and one on each of the left and right sides. The underwater propeller V and the compressed air chamber III work simultaneously, so that the robot completes a series of movements of suspension travel and direction change, real-time coordination, and the collection process is flexible and efficient.

When the robot advances, the propellers V on both sides rotate at the same rotational speed to generate thrust to move the robot forward. When the robot turns, the underwater propeller V speed on one side decreases (until it stops or even reverses), and the other side speed increases to complete the steering operation. (For example, when the robot turns left, the left underwater propeller V decelerates or stops running, and the right underwater propeller V speed remains unchanged. After the steering is finished, the rotation speed is the same, and the straight line continues).

A method for collecting deep sea polymetallic nodules using a robot, including the following steps:

Discharging the water in the airfoil floating cabin I, after the robot sneaked into the deep-sea working area with the airfoil floating cabin I full of water, and the robot reached a force balance and remained in suspension.

The first stage: identifying a polymetallic nodule distribution area by a camera of an image acquisition module, moving the robot to the polymetallic nodule distribution area by the underwater propeller V and making the inlet of the collecting tube IV aims at the polymetallic nodule distribution area and prepares for collection.

The second stage: moving the piston 7 of the collecting pump II to downward, after the collection port captures the polymetallic nodules, and at this time, a vacuum (or a small pressure) space is formed inside the collecting pump II. Since the pressure outside the collection port of the collecting tube IV is much larger than the pressure inside the collecting pump II, under the action of external pressure, the collection port and the collecting tube IV generate an upward flow of water, and the polymetallic nodules move upward, and the polymetallic nodules are sucked into the collecting pump II together with the seawater. When a large amount of polymetallic nodules mixture is drawn into the collecting pump II, the internal and external pressures tend to balance.

The third stage: moving the piston 7 of the collecting pump II upward, after the pressure tends to balance, it is no longer possible to collect polymetallic nodules into the robot. At this time, the check valve 8 is opened, the water in the collecting pump II is discharged from the check valve 8 below, and the polymetallic nodules are discharged, and are rolled down the slope into the collecting frame VI. At the same time, a part of the muddy sand is separated from the pores of the collecting frame VI by the high-speed water flow generated by the collecting pump II. As the piston 7 moves upwards, the water in the pump and the polymetallic nodules are discharged, and the collecting pump II returns to its original state. At this point, the robot's own weight increases, the force balance is broken, the airfoil floating cabin I discharges the same amount of water, and the collection device reaches equilibrium again and remains in suspension. At this point, the round of collection is over.

The fourth stage: repeating the above operation to perform a new round of collection operation. When the collecting frame VI is full, move the robot to the transfer station to release the collecting frame VI or float up to complete the deep-sea polymetallic nodules collection operation by the underwater moving carrier.

Compared with the original method, the obvious advantage is that the suction is provided more, and the polymetallic nodules can be accurately collected, and the damage to the seabed environment is small. The suction is generated by the pressure difference, and the polymetallic nodules are collected into the robot. The entire collection process has almost no damage to the polymetallic nodules, thereby ensuring the integrity of the polymetallic nodules and facilitating the subsequent separation and transportation work.

What is claimed is:

1. A robot for collecting deep-sea polymetallic nodules, comprising an underwater moving carrier and a collecting module; wherein the collecting module is fixedly mounted on the underwater moving carrier and thereby is movable underwater by the underwater moving carrier;

the collecting module comprises a collecting frame, a collecting pump, a rack, and a collecting tube; the collecting frame is installed at a bottom of the rack, the collecting pump is a piston pump which comprises a piston and a cylinder with open lower-end, an upper part of the cylinder is a collecting area, a lower part of the cylinder is a piston stroke area, the piston is installed in the piston stroke area, an end of the collecting tube is connected to the collecting area of the cylinder, a check valve being one-way openable downwardly is provided in a middle of the piston, the collecting pump is mounted on the rack, an outlet at the lower-end of the cylinder is connected to an inlet at a top of the collecting frame, and the other end of the collecting tube extends downwardly in order to contact with a ground around the collecting module.

2. The robot according to claim 1, wherein the cylinder is a circular cylinder, an upper surface of the piston is in a shape of a slope having a low central portion and a high periphery, and the check valve being one-way openable downwardly is hinged in the middle of the piston.

3. The robot according to claim 2, wherein the piston is configured for being driven to move upwardly and downwardly by a driving device; and the driving device comprises an eccentric wheel, a connecting rod and a motor, the eccentric wheel is mounted at the lower part of the cylinder, the eccentric wheel is connected to the piston through the connecting rod, the motor and the eccentric wheel are coupled by power transmission, and the motor is mounted in the rack.

4. The robot according to claim 2, wherein a number of the collecting pump is multiple, the multiple collecting pumps correspondingly are provided with multiple the collecting tube respectively, the multiple collecting tubes are evenly disposed on both sides of the rack, and a nozzle of each the collecting tube is provided with a thickened protection ring.

5. The robot according to claim 2, wherein the collecting tube is made of a rigid material, and an inlet of the collecting tube is a port with gradually reduced size.

6. The robot according to claim 2, wherein the collecting frame is made of a porous mesh and comprises a bottom storage section and a top separation section, the top separation section is a slope-shaped filter screen and configured for separating polymetallic nodules and muddy sand.

7. The robot according to claim 2, wherein the underwater moving carrier comprises an airfoil floating cabin, a compressed air chamber and an underwater propeller, the airfoil floating cabin is a sealed hollow chamber and installed above the rack by a fixing device, the airfoil floating cabin is provided with three ports with control valves being an air intake port, an air exhaust port, and a water intake/exhaust port respectively; the air intake port is communicated with the compressed air chamber through a connecting pipe, the air exhaust port and the water intake/exhaust port are communicated with an external environment of the airfoil floating cabin; a number of the compressed air chamber is two and the two compressed air chambers are symmetrically fixedly mounted on both sides of the rack; the two compressed air chambers are used for being filled a high pressure gas therein and adjusting an amount of water in the airfoil floating cabin by the high pressure gas to realize ascending and diving functions, and the underwater propeller is configured for propelling the underwater moving carrier to move underwater.

8. The robot according to claim 7, wherein the underwater propeller comprises two propellers, and the two propellers are symmetrically mounted on both sides of the collecting frame below the rack, and the two propellers are independently controlled through two motors at rotational speeds to achieve forward, backward and differential steering.

9. The robot according to claim 1, wherein an image acquisition module is mounted on the underwater moving carrier.

10. A method for collecting deep-sea polymetallic nodules using a robot, comprising the following steps:

Step 1, filling an airfoil floating cabin of the robot with water to make the robot dive to a deep-sea working area, and then draining off the water by a high pressure gas in a compressed air chamber to make the robot be in a suspended and force-balanced state;

Step 2, identifying a polymetallic nodule distribution area by a camera of an image acquisition module, moving the robot to the polymetallic nodule distribution area by an underwater propeller and making an inlet of a collecting tube aim at the polymetallic nodule distribution area;

Step 3, starting a collecting pump to make a piston of the collecting pump move downwardly to thereby form a negative pressure in a collecting area of a cylinder of the collecting pump, and sucking a mixture of polymetallic nodules and muddy sand at the inlet of the collecting tube under an action of the negative pressure;

Step 4, moving the piston of the collecting pump upwardly, to make the mixture of polymetallic nodule muddy sand enter a collecting frame through a check valve disposed on the piston;

Step 5, discharging a certain amount of water in the airfoil float cabin to allow the robot to be suspended and force-balanced again when the robot sinks caused by that the collecting frame become heavier as the collecting progresses;

Step 6, repeating the step 2 through the step 5 to perform the collecting, and moving the robot to a transfer station for releasing the collecting frame or to float up by an underwater moving carrier when the collecting frame is full, so as to complete the collecting of deep-sea polymetallic nodules.

* * * * *